US008231694B2

(12) United States Patent
Gernon et al.

(10) Patent No.: US 8,231,694 B2
(45) Date of Patent: Jul. 31, 2012

(54) USE OF MIXTURES OF ALKYLALKANOLAMINES AND ALKYLHYDROXYLAMINES AS STABILIZERS FOR ALKYL ESTER FUELS

(75) Inventors: Michael D. Gernon, Phoenixville, PA (US); Nicholas M. Martyak, Doylestown, PA (US); Conor M. Dowling, Ambler, PA (US)

(73) Assignee: Arkema France, Colombes (FR)

( * ) Notice: Subject to any disclaimer, the term of this patent is extended or adjusted under 35 U.S.C. 154(b) by 805 days.

(21) Appl. No.: 12/303,972

(22) PCT Filed: May 23, 2007

(86) PCT No.: PCT/US2007/069534

§ 371 (c)(1), (2), (4) Date: Dec. 9, 2008

(87) PCT Pub. No.: WO2007/146567

PCT Pub. Date: Dec. 21, 2007

(65) Prior Publication Data

US 2011/0203167 A1 Aug. 25, 2011

Related U.S. Application Data

(60) Provisional application No. 60/812,219, filed on Jun. 9, 2006.

(51) Int. Cl.
*C10L 1/18* (2006.01)
*C10L 1/22* (2006.01)

(52) U.S. Cl. ..... 44/388; 44/423; 44/434

(58) Field of Classification Search ..... 44/388, 44/423, 434

See application file for complete search history.

(56) References Cited

U.S. PATENT DOCUMENTS

| | | | | |
|---|---|---|---|---|
| 4,011,057 | A * | 3/1977 | Sayers | 44/412 |
| 4,409,000 | A * | 10/1983 | LeSuer | 44/386 |
| 4,549,885 | A * | 10/1985 | Knapp | 44/325 |
| 4,599,090 | A * | 7/1986 | Steckel | 44/334 |
| 4,840,720 | A | 6/1989 | Reid | |
| 6,299,655 | B1 | 10/2001 | Steckel et al. | |
| 2005/0262760 | A1 | 12/2005 | Lawson et al. | |

OTHER PUBLICATIONS

Schumacher et al., "Fueling Diesel Engines with Blends of Methyl Ester Soybean Oil and Diesel Fuel", Biodiesel (online), 1994.

* cited by examiner

*Primary Examiner* — Cephia D Toomer
(74) *Attorney, Agent, or Firm* — RatnerPrestia

(57) ABSTRACT

A stabilized alkyl ester fuel is disclosed. The stabilized alkyl ester fuel comprises alkyl esters, an effective amount of an alkylalkanolamine, and an effective amount of an alkylhydroxylamine. The alkyl ester fuel is stabilized to oxidative degradation of the alkyl esters of unsaturated fatty acids found in alkyl ester fuels.

11 Claims, No Drawings

USE OF MIXTURES OF ALKYLALKANOLAMINES AND ALKYLHYDROXYLAMINES AS STABILIZERS FOR ALKYL ESTER FUELS

FIELD OF THE INVENTION

This invention relates to alkyl ester fuels. In particular, this invention relates to the use of mixtures of alkylalkanolamines and alkylhydroxylamines as stabilizers for alkyl ester fuels.

BACKGROUND OF THE INVENTION

The fuels currently used in transport vehicles are predominately obtained from refining petroleum, a non-renewable resource. Environmental problems coupled with petroleum reserve depletion has stimulated development of renewable transportation fuels. One renewable fuel oil source is biodiesel, a clean-burning alternative fuel produced from renewable resources. Biodiesel contains no petroleum, but it can be blended in any concentration at any level with petroleum based diesel fuel to create a fuel blend. Because it has similar combustion properties as diesel, biodiesel can be used in existing compression-ignition (diesel) engines with little or no modification. Biodiesel is biodegradable, essentially non-toxic, and essentially free of sulfur and aromatic compounds, and thus can provide certain environmental advantages.

Biodiesel is essentially a mixture of methyl and/or ethyl esters of fatty acids, typically made by transesterification of fatty acid triglycerides (vegetable oils and/or animal fats) with an alcohol such as methanol and/or ethanol in the presence of a catalyst to yield mono-alkyl esters and glycerin, which is removed. In addition to saturated fatty acids, such as stearic acid (n-octadecanoic acid) and palmitic acid (n-hexadecanoic acid), these naturally occurring oils contain unsaturated fatty acids, such acids as oleic acid (cis-9-octadecenoic acid), linoleic acid (cis, cis-9,12-octadecadienoic acid), α-linolenic (cis-cis-cis-9,12,15-octadecatrienoic acid), and other fatty acids bearing one or more carbon-carbon double bonds. Alkyl ester fuels made from these oils also contains esters, typically methyl and/or ethyl esters, of these unsaturated acids.

Storage stability is a problem with alkyl ester fuels because the unsaturation makes them susceptible to oxidation. The fatty acid esters can be oxidized by atmospheric oxygen and/or be metabolized by microbes to produce shorter chain carboxylic acids that generate a characteristic foul odor and excess acidity. An alkyl ester fuel that has been significantly degraded by oxidation and/or microbiological colonization is generally referred to rancid. The odor of a rancid alkyl ester fuel is easily detected, and the acid number, generally expressed as the milligrams of potassium hydroxide consumed per gram of fuel, will be significantly elevated. Excess acidity in alkyl ester fuels causes a number of problems, including corrosion, poor combustion, elevated pour point, valve deposits, and accelerated decomposition. Thus, a need exists for ways of reducing or eliminating oxidative degradation of the alkyl esters of unsaturated fatty acids found in alkyl ester fuels.

SUMMARY OF THE INVENTION

In one aspect, the invention is a stabilized alkyl ester fuel comprising:

alkyl esters, an effective amount of an alkylalkanolamine, and an effective amount of an alkylhydroxylamine.

In another aspect, the invention is a method for preparing a stabilized fuel, the method comprising adding an alkylalkanolamine and an alkylhydroxylamine to fuel comprising alkyl esters. In another aspect, the invention is a blended fuel comprising about 5 to 75 wt % of the stabilized alkyl ester containing fuel and about 25 to 95 wt % of petroleum-based diesel fuel.

DETAILED DESCRIPTION OF THE INVENTION

Unless the context indicates otherwise, in the specification and claims, the terms alkyl ester, alkylalkanolamine, alkylhydroxylamine, additive, and similar terms also include mixtures of such materials. Unless otherwise specified; all percentages are percentages by weight and all temperatures are in degrees Centigrade (degrees Celsius).

In one aspect, the invention is a stabilized fuel comprising alkyl esters, and effective amount of an alkylalkanolamine, or a mixture of alkylalkanolamines, and an effective amount of an alkylhydroxylamine, or a mixture of alkylhydroxylamines. Conventional additives may also be present.

The alkylalkanolamines have the structure $$R^1R^2NCH_2CH_2OH$$

in which $R^1$ is an alkyl group of 3 to 24 carbon atoms or an isoalkyl group, and $R^2$ is —H, —$CH_2CH_2OH$, or —$R^1$.

Preferably, $R^1$ is an alkyl group or an isoalkyl group of 3 to 9 carbon atoms, More preferably, the alkylalkanolamine comprises 5 to 16 carbon atoms. Alkylalkanolamines include, for example, butyldiethanolamine (BDAE) ($n\text{-}C_4H_9N(CH_2CH_2OH)_2$), butylaminoethanol (BAE) ($(n\text{-}C_4H_9)HNCH_2CH_2OH_2$), dibutylaminoethanol (DBAE) ($(n\text{-}C_4H_9)_2NCH_2CH_2OH$), diisopropylaminoethanol (DIPAE) ($(i\text{-}C_3H_7)_2NCH_2CH_2OH$), octylaminoethanol (OAE) ($(n\text{-}C_8H_{17})N(CH_2CH_2OH)_2$), and octyldiethanolamine (ODEA) ($(n\text{-}C_8H_{17})HNCH_2CH_2OH_2$). Mixtures of two or more of the alkylalkanolamines may also be used.

The alkylhydroxylamines have the structure:

$$R^3R^4NOH$$

in which $R^3$ is an alkyl or an isoalkyl group of 2 to 24 carbon atoms, and $R^4$ is —H or —$R^3$.

Alkylhydroxyamines include, for example, N-ethylhydroxylamine, N,N-diethylhydroxylamine, N-n-propylhydroxylamine, N,N-di-n-propylhydroxylamine, N-iso-propylhydroxylamine, N,N-di-iso-propylhydroxylamine, N-n-butylhydroxylamine, N,N-di-n-butylhydroxylamine, N-n-hexylhydroxylamine, N,N-di-n-hexylhydroxylamine, N-n-octylhydroxylamine, N,N-di-n-octylhydroxylamine, N-n-decylhydroxylamine, and N,N-di-n-decylhydroxylamine. A preferred alkylhydroxyamine is N,N-diethylhydroxylamine (DEHA) ($(C_2H_5)_2NOH$).

The stabilized alkyl ester fuel comprise an effective amount of the alkylalkanolamine, or the mixture of alkylalkanolamines, and an effective amount of the alkylhydroxylamine, or the mixture of alkylhydroxylamines. An effective amount is the amount necessary to achieve the desired result, stabilization of the alkyl ester fuel by reducing or eliminating the oxidative degradation of the alkyl esters of unsaturated fatty acids found in alkyl ester fuels. Typically an effective amount of the alkylalkanolamine, or the mixture of alkylalkanolamines, is about 10 ppm to 500 ppm by weight, relative to the weight of the stabilized alkyl ester fuel. Typically an effective amount of the alkylhydroxylamine, or the mixture of alkylhydroxylamines, is about 10 ppm to 500 ppm by weight, relative to the weight of the stabilized alkyl ester fuel.

The stabilized alkyl ester fuel comprises a mixture of methyl and/or ethyl esters of fatty acids, typically made by transesterification of fatty acid triglycerides (vegetable oils and/or animal fats) with an alcohol such as methanol and/or ethanol in the presence of a catalyst to yield mono-alkyl esters and glycerin, which is removed. Such processes are well known to those skilled in the art. The most commonly used raw material oils are triglyceride seed oils (e.g., soybean oil, canola oil, palm oil, rapeseed oil, sunflower oil, olive oil, mustard oil, linseed oil, tung oil, etc.). Animal fats, such as lard and beef tallow, may also be used. The exact alkyl ester composition will depend on the raw material or materials used, the alcohol used for the transesterification process, and the processing conditions. However, the alkyl ester fuel typically contains at least the methyl and/or ethyl esters of palmitic acid, stearic acid, oleic acid, linoleic acid, and linolenic acids. The five main fatty acids found in the triglycerides of soybean oil are, for example, palmitic acid, stearic acid, oleic acid, linoleic acid, and linolenic acids.

"Biodiesel" is an alkyl ester fuel that meets the specifications of the American Society for Testing and Materials (ASTM) D 6751, incorporated herein by reference. Biodiesel has a minimum closed cup flash point of 130° C., a minimum cetane number of 47, and a distillation temperature, atmospheric equivalent temperature, 90% recovered, of 360° C. maximum. Free glycerin is 0.020% or less. Total glycerin is 0.240% or less.

The ingredients of the additive composition may simply be blended with the alkyl ester fuel either individually, or together, or together with other additives as an additive package. Blending does not require any heating or other special processing steps. Therefore, blending may be carried out at ambient temperatures, although lower or higher temperatures may be used as long as mixing is reasonably facile and undesired reactions do not occur. Typically, the temperature will be from 10° to 50° C.

The stabilized fuel may also comprise one or more additives to affect the properties of the fuel, such as the viscosity of the fuel at 35° C. (or at engine operating temperature), the pour point of the fuel, the rate or extent of rust formation or other corrosion of metals in contact with the treated fuel, and the growth of bacteria, molds, fungi, slimes, and other microbial forms in the fuel. These additives may be added at the refinery, at the fuel distribution terminal, into the tanker, or as additives purchased by the end user for addition into the fuel tank of an individual vehicle. The additives may be added individually or some or all of the additives may be added as a pre-formulated additive package. These additives are well know to those skilled in the art and may include, for example, cold flow improvers (also known as middle distillate flow improvers), such as ethylene/vinyl acetate copolymers; wax antisettling additives; diesel fuel stabilizers; antioxidants, such as a hindered phenol antioxidants; cetane number improvers, such as nitroalkanes (for example, 2-ethylhexyl nitrate, amyl nitrate, hexyl nitrate, and mixed octyl nitrates) nitro carbonates, and peroxides; combustion improvers; detergents and dispersants; dehazers and demulsifiers, such as alkylaryl sulfonates, polyoxyalkylene glycols and oxyalkylated alkylphenolic resins; anti-foam agents; lubricity additives; anti-static additives; metal deactivators and/or rust and corrosion inhibitors; drag reducing agents; biocides; and dyes and markers.

These additives can be added in any effective amount to achieve a desired result, although they preferably amount to less than a few percent by weight of the composition. Antioxidants, for example, are added at below 500 ppm, typically below 200 ppm, and most typically from 5 to 100 ppm.

INDUSTRIAL APPLICABILITY

The stabilized fuels of the invention can be used without the addition of petroleum distillates, as, for example, "biodiesel," or they can be used as a mixture of alkyl esters and petroleum distillates. Suitable petroleum distillates include any of a variety of petroleum-based fuels, including but not limited to those normally referred to as "diesel."

The stabilized fuels of the invention are useful as fuels for compression-ignition (diesel) engines. The stabilized fuel can be used directly in a diesel engine, or can be mixed with petroleum-based diesel fuel ("diesel" fuel). The stabilized fuel and the petroleum-based diesel fuel can be mixed in any suitable manner. "Biodiesel" refers to the pure fuel before blending with diesel fuel. Biodiesel blends are denoted as, "BXX" with "XX" representing the percentage of biodiesel contained in the blend (i.e., B20 is 20% biodiesel, 80% petroleum diesel). The resulting blended fuel typically comprises 5 wt % or more of the stabilized alkyl ester containing fuel. A typical blended fuel comprises about 5 to 75 wt % of the stabilized alkyl ester containing fuel and about 25 to 95 wt % of petroleum-based diesel fuel. Diesel engines are widely used in vehicles used in transportation, such as in trucks, busses, railroad locomotives, and ships, as well as in off the road vehicles for such applications as construction, logging, and mining.

The stabilized fuels of the invention are also useful as fuel oils, which are used mainly in industrial and domestic heating, as well as in the production of steam and electricity in power plants. For this application, the stabilized fuel can be used directly or can be mixed with petroleum-based fuel oil in any desired ratio.

The advantageous properties of this invention can be observed by reference to the following examples, which illustrate but do not limit the invention.

EXAMPLES

Glossary

BAE Butylaminoethanol
BDAE Butyldiethanolamine
DBAE Butylaminoethanol
DEHA N,N-diethylhydroxylamine
DIPAE Diisopropylaminoethanol
OAE Octylaminoethanol
ODEA Octyldiethanolamine

General Procedures

Example 1

A sample of commercial soy biodiesel was subjected to the Rancimat test method (passing air through a heated (110° C.) sample of biodiesel and determining the number of hours it takes to degrade the biodiesel). To other samples were added 1000 ppm DEHA, 1000 ppm ODEA and 1000 ppm ODEA+500 ppm DEHA. The results of the Rancimat tests are:

1. Blank (biodiesel only): 2.41 hours
2. Biodiesel+500 ppm DEHA: 7.48 hours
3. Biodiesel+1000 ppm ODEA: 5.36 hours
4. Biodiesel+1000 ppm ODEA+500 ppm DEHA: >12 hours The addition of both ODEA and DEHA delayed biodiesel degradation to greater than 12 hours (after 12 hours, the test was stopped but the biodiesel was still not degraded).

Having described the invention, we now claim the following and their equivalents.

The invention claimed is:

1. A stabilized alkyl ester fuel comprising:

alkyl esters; and an effective amount to provide stabilization of the alkyl ester fuel by reducing or eliminating the oxidative degradation of alkyl esters of unsaturated fatty acids of a combination of at least one alkylalkanolamine; and at least one alkylhydroxylamine.

2. The stabilized alkyl ester fuel of claim 1 wherein said alkyl ester is a methyl ester of fatty acids, an ethyl ester of fatty acids or a mixture thereof.

3. The stabilized alkyl ester fuel of claim 2 wherein said fatty acids are unsaturated or mixtures of saturated and unsaturated fatty acids.

4. The stabilized alkyl ester fuel of claim 3 wherein said saturated fatty acids are selected from stearic acid or palmitic acid.

5. The stabilized alkyl ester fuel of claim 3 wherein said unsaturated acids are selected from oleic acid, linoleic acid, α-linolenic or mixtures thereof.

6. A blended fuel comprising the stabilized alkyl ester fuel of claim 1 and a petroleum based diesel fuel wherein said blended fuel comprises from about 5-75 weight % stabilized alkyl ester fuel of claim 1 and from about 25-95 weight % petroleum based diesel fuel.

7. The stabilized alkyl ester fuel of claim 1 wherein said alkylalkanolamine has the structure:

$$R^1R^2NCH_2CH_2OH$$

in which $R^1$ is an alkyl group or an isoalkyl group of 3 to 24 carbon atoms and $R^2$ is —H, —$CH_2CH_2OH$, or —$R^1$.

8. The stabilized alkyl ester fuel of claim 7 wherein alkylalkanolamine is selected from butyldiethanolamine (BDAE) ($n\text{-}C_4H_9N(CH_2CH_2OH)_2$), butylaminoethanol (BAE) ($(n\text{-}C_4H_9)HNCH_2CH_2OH$), dibutylaminoethanol (DBAE) ($(n\text{-}C_4H_9)_2NCH_2CH_2OH$), diisopropylaminoethanol (DIPAE) ($(i\text{-}C_3H_7)_2NCH_2CH_2OH$), octylaminoethanol (OAE) ($(n\text{-}C_8H_{17})HNCH_2CH_2OH$), octyldiethanolamine (ODEA) ($(n\text{-}C_8H_{17})N(CH_2CH_2OH)_2$) or mixtures thereof.

9. The stabilized alkyl ester fuel of claim 1 wherein said alkylhydroxylamine has the structure:

$$R^3R^4NOH$$

in which $R^3$ is an alkyl group of 2 to 24 carbon atoms or an isoalkyl group of 3 to 24 carbon atoms, and $R^4$ is —H or —$R^3$.

10. The stabilized alkyl ester fuel of claim 9 wherein said alkylhydroxylamine is selected from N-ethylhydroxylamine, N,N-diethylhydroxylamine, N-n-propylhydroxylamine, N,N-di-n-propylhydroxylamine, N-iso-propylhydroxylamine, N,N-di-iso-propylhydroxylamine, N-n-butylhydroxylamine, N,N-di-n-butylhydroxylamine, N-n-hexylhydroxylamine, N,N-di-n-hexylhydroxylamine, N-n-octylhydroxylamine, N,N-di-n-octylhydroxylamine, N-n-decylhydroxylamine, N,N-di-n-decylhydroxylamine or mixtures thereof.

11. The stabilized alkyl ester fuel of claim 1, further comprising viscosity modifiers, pour point modifiers, corrosion inhibitors, bactericides, fungicides, antioxidants, stabilizers, cetane number improvers, detergents, dispersants, anti-foam agents, lubricity additives, anti-static additives, dyes, markers or mixtures thereof.

* * * * *